US010973279B2

(12) United States Patent
Cheney et al.

(10) Patent No.: US 10,973,279 B2
(45) **Date of Patent: *Apr. 13, 2021**

(54) RAPID-ENTRY FOOTWEAR HAVING A COMPRESSIBLE LATTICE STRUCTURE

(71) Applicant: FAST IP, LLC, Vineyard, UT (US)

(72) Inventors: Craig Cheney, Orem, UT (US); Steven Hermann, Lehi, UT (US)

(73) Assignee: FAST IP, LLC, Vineyard, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/899,586

(22) Filed: Jun. 12, 2020

(65) Prior Publication Data

US 2020/0305552 A1 Oct. 1, 2020

Related U.S. Application Data

(63) Continuation of application No. PCT/US2019/067437, filed on Dec. 19, 2019.

(60) Provisional application No. 62/789,367, filed on Jan. 7, 2019, provisional application No. 62/935,556, filed on Nov. 14, 2019.

(51) Int. Cl.

| | |
|---|---|
| ***A43B 3/24*** | (2006.01) |
| ***A43B 11/00*** | (2006.01) |
| ***A43B 23/02*** | (2006.01) |
| ***A43C 11/00*** | (2006.01) |
| ***A43B 21/26*** | (2006.01) |

(52) U.S. Cl.

CPC ..... *A43B 11/00* (2013.01); *A43B 3/242* (2013.01); *A43B 3/248* (2013.01); *A43B 21/26* (2013.01); *A43B 23/027* (2013.01); *A43C 11/004* (2013.01)

(58) Field of Classification Search

CPC ..... A43B 1/0018; A43B 3/248; A43B 3/11; A43B 23/088; A43B 23/17; A43C 11/0008

USPC ..... 36/58.6, 105

See application file for complete search history.

(56) References Cited

U.S. PATENT DOCUMENTS

| | | | |
|---|---|---|---|
| 112,439 | A | 3/1871 | Francis |
| 808,948 | A | 1/1906 | Roberts et al. |
| 827,330 | A | 7/1906 | Tillson |
| 863,549 | A | 8/1907 | Metz |
| 881,153 | A | 3/1908 | Rickert |

(Continued)

FOREIGN PATENT DOCUMENTS

| | | |
|---|---|---|
| CN | 2438353 | 7/2001 |
| CN | 1403041 | 3/2003 |

(Continued)

OTHER PUBLICATIONS

U.S. Appl. No. 62/186,148, filed Jun. 29, 2015, Zahabian.

(Continued)

*Primary Examiner* — Sharon M Prange

(57) ABSTRACT

Disclosed is a shoe having a compressible lattice structure in a heel portion to facilitate rapid, easy donning and doffing of shoes. In example embodiments, the lattice structure includes a plurality of interconnected, overlapping, intersecting and/or woven ribs defining a plurality of apertures. The lattice structure has an open position in which the shoe opening is expanded to facilitate reception of a foot of an individual wearing the rapid-entry shoe, and a closed position in which the shoe opening is smaller to retain the foot within the rapid-entry shoe.

20 Claims, 16 Drawing Sheets

(56) References Cited

U.S. PATENT DOCUMENTS

| | | | | |
|---|---|---|---|---|
| 923,860 | A | 6/1909 | Kroell | |
| 921,461 | A | 9/1909 | Rickert | |
| 1,081,678 | A | 12/1913 | Langerak | |
| 1,116,462 | A | 11/1914 | Moran | |
| 1,464,342 | A | 8/1923 | Rothacher | |
| 1,494,236 | A | 5/1924 | Greathouse | |
| 1,686,175 | A | 10/1928 | Read | |
| 1,926,818 | A | 9/1933 | Ratcliff | |
| 2,069,752 | A | 8/1935 | Dorr | |
| 2,266,732 | A | 4/1940 | Babinchak | |
| 2,368,514 | A | 1/1945 | Baehr | |
| 2,450,250 | A | 3/1945 | Napton | |
| 2,452,502 | A | 4/1945 | Tarbox | |
| 2,736,110 | A | 2/1956 | Hardimon | |
| 2,763,071 | A | 9/1956 | Kingsley | |
| 2,829,448 | A | 4/1958 | Minera | |
| 2,920,402 | A | 1/1960 | Minera | |
| 3,000,116 | A | 9/1961 | Ally | |
| 3,146,535 | A | 9/1964 | Owings | |
| 4,489,509 | A | 12/1984 | Libit | |
| 4,590,690 | A | 5/1986 | Pfander | |
| 4,811,502 | A | 3/1989 | Barret | |
| 4,924,605 | A | 5/1990 | Spademan | |
| 4,972,613 | A | 11/1990 | Loveder | |
| 5,054,216 | A | 10/1991 | Lin | |
| 5,127,170 | A | 7/1992 | Messina | |
| 5,181,331 | A | 1/1993 | Berger | |
| 5,184,410 | A | 2/1993 | Hamilton | |
| 5,282,327 | A | 2/1994 | Ogle | |
| 5,341,583 | A | 8/1994 | Hallenbeck | |
| 5,353,526 | A * | 10/1994 | Foley | A43B 1/0009 36/35 R |
| 5,371,957 | A | 12/1994 | Gaudio | |
| 5,467,537 | A | 11/1995 | Aveni et al. | |
| 5,481,814 | A | 1/1996 | Spencer | |
| 5,842,292 | A | 12/1998 | Siesel | |
| 5,997,027 | A | 12/1999 | Jungkind | |
| 6,000,148 | A | 12/1999 | Cretinon | |
| 6,125,555 | A | 10/2000 | Schenkel | |
| 6,189,239 | B1 | 2/2001 | Gasparovic et al. | |
| 6,360,454 | B1 | 3/2002 | Dachgruber | |
| 6,378,230 | B1 | 4/2002 | Rotem et al. | |
| 6,671,980 | B1 | 1/2004 | Liu | |
| 6,684,533 | B1 | 2/2004 | Su | |
| 6,922,917 | B2 | 8/2005 | Kerns | |
| 6,925,732 | B1 | 8/2005 | Clarke | |
| 6,938,361 | B2 | 9/2005 | Su | |
| 7,103,994 | B2 | 9/2006 | Johnson | |
| 7,178,270 | B2 | 2/2007 | Hurd et al. | |
| 7,225,563 | B2 | 6/2007 | Chen | |
| 7,439,837 | B2 | 10/2008 | McDonald | |
| 7,661,205 | B2 | 2/2010 | Johnson | |
| 7,685,747 | B1 | 3/2010 | Gasparovic et al. | |
| 7,793,438 | B1 | 9/2010 | Busse et al. | |
| 7,823,299 | B1 | 11/2010 | Brigham | |
| 7,975,403 | B2 | 7/2011 | Mosher | |
| D648,512 | S | 11/2011 | Schlageter | |
| 8,065,819 | B2 | 11/2011 | Kaufman | |
| 8,087,188 | B2 | 1/2012 | Labbe | |
| 8,161,669 | B2 | 4/2012 | Keating | |
| 8,225,535 | B2 | 7/2012 | Dillenbeck | |
| 8,499,474 | B2 | 8/2013 | Kaufman | |
| 8,769,845 | B2 | 7/2014 | Lin | |
| 9,615,624 | B2 | 4/2017 | Kilgore et al. | |
| 9,675,132 | B2 | 6/2017 | Marshall | |
| 9,820,527 | B2 | 11/2017 | Pratt et al. | |
| 9,877,542 | B2 | 1/2018 | Pratt | |
| 10,306,947 | B2 | 6/2019 | Pratt et al. | |
| 10,455,898 | B1 | 10/2019 | Orand et al. | |
| 10,638,810 | B1 * | 5/2020 | Cheney | A43B 3/248 |
| 2002/0144434 | A1 | 10/2002 | Farys | |
| 2005/0022428 | A1 | 2/2005 | Anderson | |
| 2005/0039348 | A1 | 2/2005 | Raluy et al. | |
| 2005/0076540 | A1 | 4/2005 | Su | |
| 2005/0198867 | A1 | 9/2005 | Labbe | |
| 2007/0074425 | A1 | 4/2007 | Leong | |
| 2007/0180730 | A1 * | 8/2007 | Greene | A43B 23/0295 36/3 A |
| 2008/0086911 | A1 | 4/2008 | Labbe | |
| 2008/0189984 | A1 | 8/2008 | Januszewski et al. | |
| 2008/0307673 | A1 | 12/2008 | Johnson | |
| 2011/0016751 | A1 | 1/2011 | Somerville | |
| 2011/0146106 | A1 | 6/2011 | Kaufman | |
| 2011/0185592 | A1 * | 8/2011 | Nishiwaki | A43B 7/16 36/69 |
| 2012/0060395 | A1 * | 3/2012 | Blevens | A43B 21/32 36/30 R |
| 2012/0216429 | A1 | 8/2012 | Bastida et al. | |
| 2012/0317839 | A1 * | 12/2012 | Pratt | A43B 3/248 36/102 |
| 2013/0185959 | A1 | 7/2013 | Coleman | |
| 2013/0219747 | A1 | 8/2013 | Lederer | |
| 2015/0305432 | A1 | 10/2015 | Wiens | |
| 2016/0374427 | A1 * | 12/2016 | Zahabian | A43B 3/24 36/102 |
| 2017/0303632 | A1 * | 10/2017 | Pratt | A43B 3/248 |
| 2017/0360143 | A1 | 12/2017 | Pratt | |
| 2017/0360151 | A1 | 12/2017 | Pratt | |
| 2018/0110287 | A1 | 4/2018 | Hopkins et al. | |
| 2018/0110292 | A1 * | 4/2018 | Beers | A43B 13/181 |
| 2018/0289109 | A1 | 10/2018 | Beers et al. | |
| 2018/0295942 | A1 | 10/2018 | Drake | |

FOREIGN PATENT DOCUMENTS

| | | |
|---|---|---|
| CN | 201005111 | 1/2008 |
| DE | 19534249 | 3/1997 |
| DE | 19611797 | 10/1997 |
| DE | 29809404 | 8/1998 |
| DE | 10247163 | 10/2002 |
| DE | 102004005288 | 8/2005 |
| EP | 1059044 | 12/2000 |
| GB | 2517399 | 8/2013 |
| JP | 181910 | 6/1989 |
| JP | 2001149394 | 6/2001 |
| JP | 2006055571 | 3/2006 |
| WO | 2007080205 | 7/2007 |
| WO | 2009089572 | 7/2009 |
| WO | 2009154350 | 12/2009 |
| WO | 2017004135 | 1/2017 |

OTHER PUBLICATIONS

Sneider, "Kizik Handsfree New York Shoe Review," https://the-gadgeteer.com/2018/06/27/kizik-handsfree-new-york-show-review/ (2018).

* cited by examiner

RAPID-ENTRY FOOTWEAR HAVING A COMPRESSIBLE LATTICE STRUCTURE

CROSS-REFERENCE TO RELATED APPLICATIONS

This application is a continuation of, claims priority to and the benefit of PCT Serial No. PCT/US19/67437 filed Dec. 19, 2019 and entitled RAPID-ENTRY FOOTWEAR HAVING A COMPRESSIBLE LATTICE STRUCTURE. PCT Serial No. PCT/US19/67437 claims priority to and the benefit of U.S. Provisional Patent Application No. 62/789,367, filed Jan. 7, 2019 entitled "RAPID-ENTRY FOOTWEAR HAVING A COMPRESSIBLE LATTICE STRUCTURE," and U.S. Provisional Patent Application No. 62/935,556, filed Nov. 14, 2019 entitled "RAPID-ENTRY FOOTWEAR HAVING A COMPRESSIBLE LATTICE STRUCTURE." All of the aforementioned applications are incorporated herein by reference in their entireties.

FIELD

The present disclosure relates to rapid-entry footwear having a compressible lattice structure.

BACKGROUND

Whether due to inconvenience or inability, donning and doffing of shoes, including tying or otherwise securing the same, may be undesirable and/or present difficulties to some individuals. The present disclosure addresses this need.

SUMMARY

Disclosed herein, in various embodiments, is a rapid-entry shoe having a compressible lattice structure to facilitate easy donning and doffing of shoes. The compressible lattice structure may bias the rapid-entry shoe from an open position toward a closed position. The open position may have an expanded shoe opening to facilitate reception of a foot of an individual wearing the rapid-entry shoe, while the closed position may have a smaller shoe opening to retain the foot within the rapid-entry shoe. Embodiments of various compressible lattice structures are described herein, as is a yoke for use with a rapid-entry shoe.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
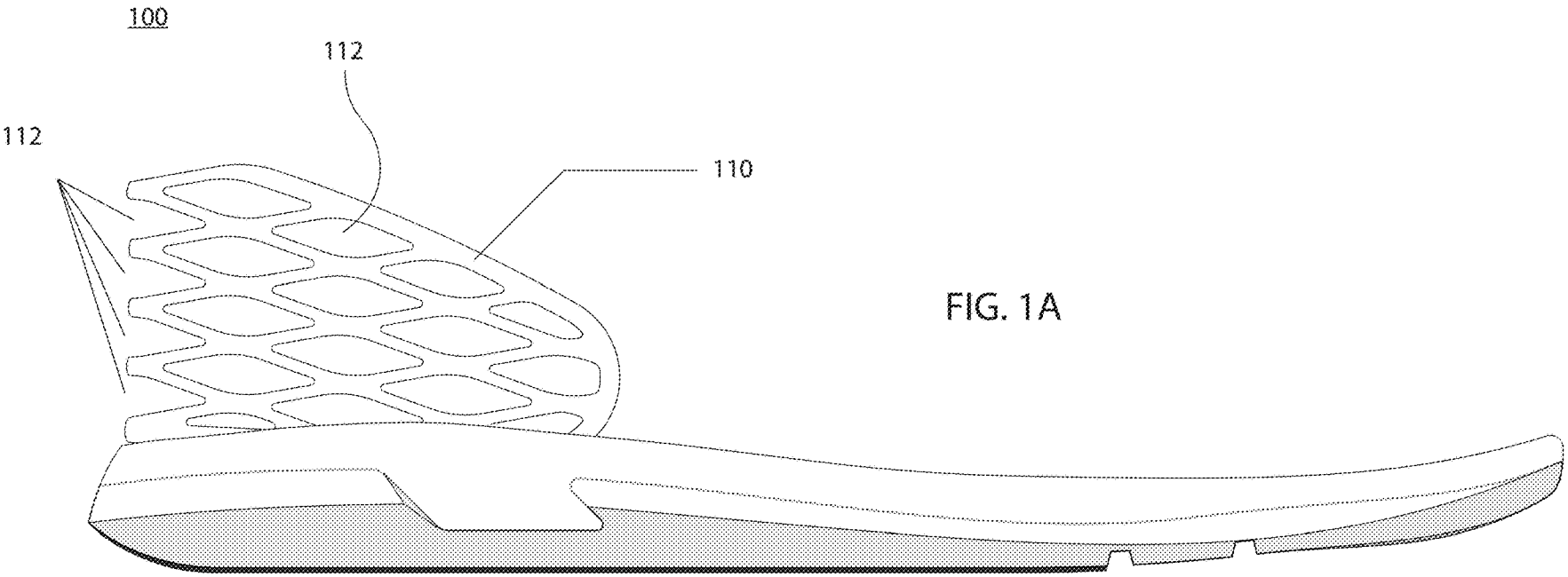
FIG. 1A illustrates a rapid-entry shoe having a compressible lattice structure, in accordance with various embodiments.
Figure 1F:
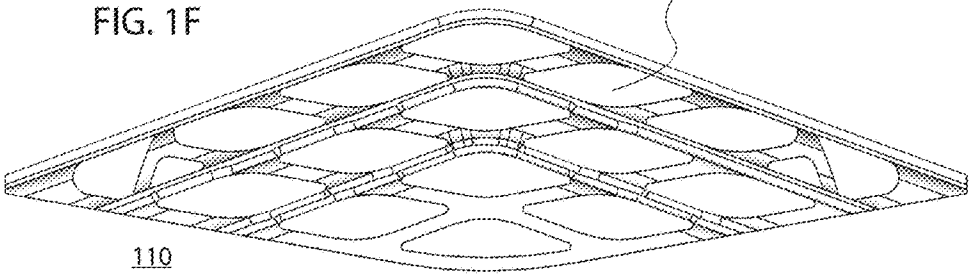
FIGS. 1B-1P illustrate different lattice structures, in accordance with various embodiments.
Figure 1G:
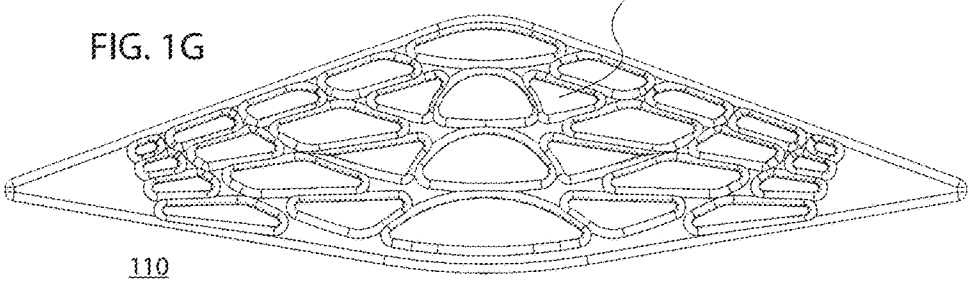
Figure 1H:
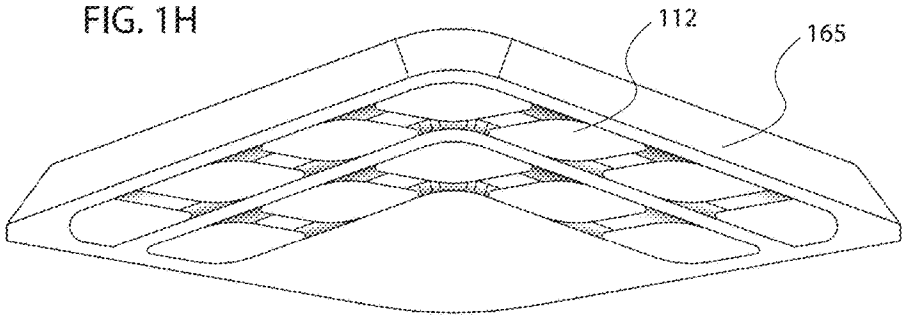

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

In various embodiments, and with reference to FIG. 1A, a rapid-entry shoe 100 is provided. The rapid-entry shoe 100 includes a heel portion that has a compressible lattice structure 110. The compressible lattice structure 110 comprises one or a plurality of interconnected, overlapping, intersecting and/or woven ribs defining one or a plurality of apertures 112, according to various embodiments. The lattice structure 110 may be a unitary structure (e.g., formed from a single mold). In some embodiments, the plurality of apertures 112 are open, pass-through slots or holes extending completely through lattice structure 110, and thus do not comprise mere folds, pleats, surface grooves or surface channels.

In example embodiments, the lattice structure 110 disclosed herein is not merely a common fabric/textile material, but instead is a material that is capable of being reversibly compressed such that it recoils back up after the foot/heel of the user is no longer applying the downward compressive force. For example, the lattice structure 100 may be made from or comprise a polymer material, a metallic material, or a composite material, among others.

Figure 1B:
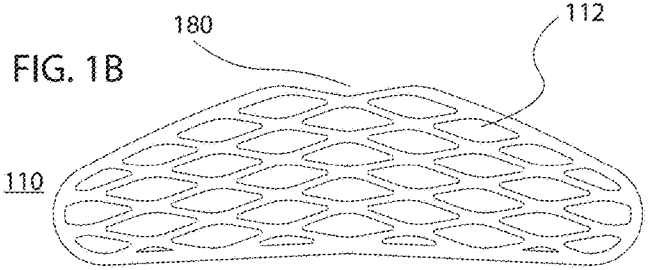
Figure 1C:
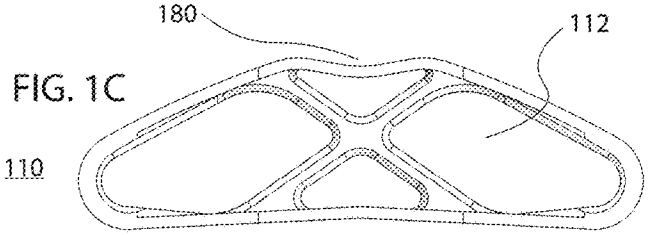
Figure 1D:
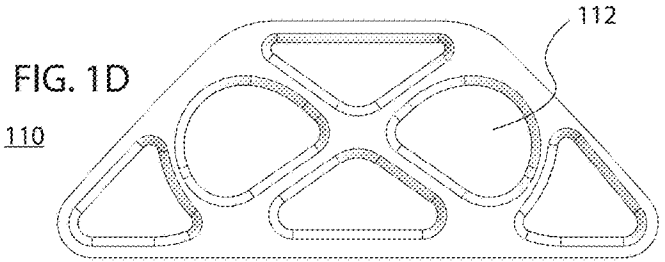
Figure 1E:
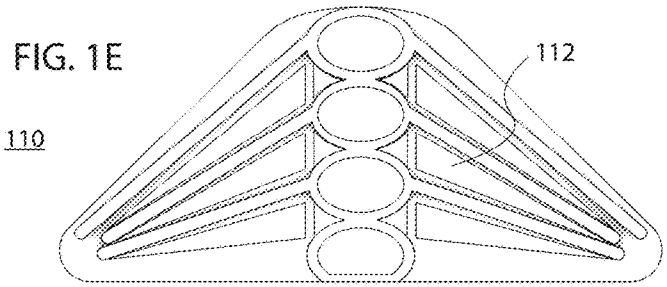
Figure 1L:
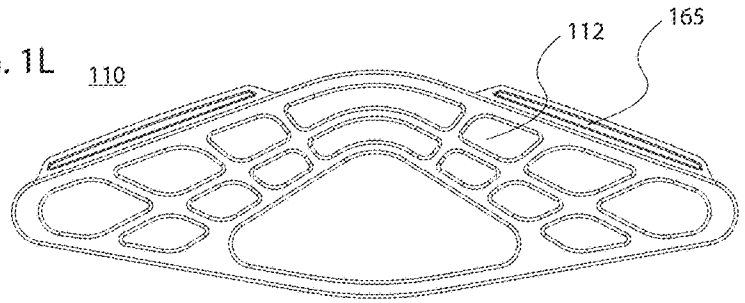
Figure 1M:
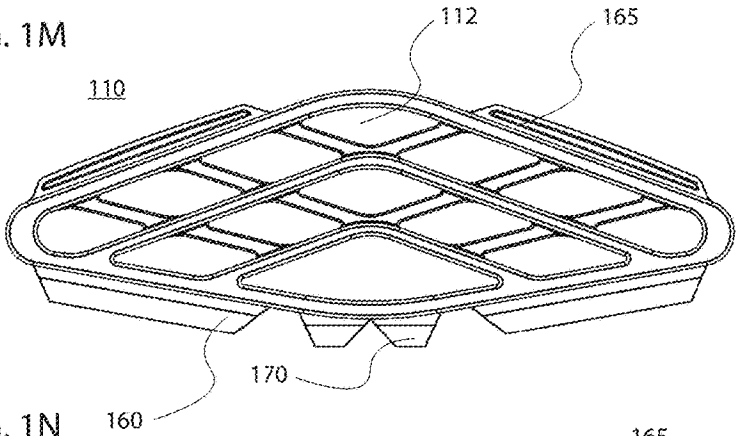
Figure 1N:
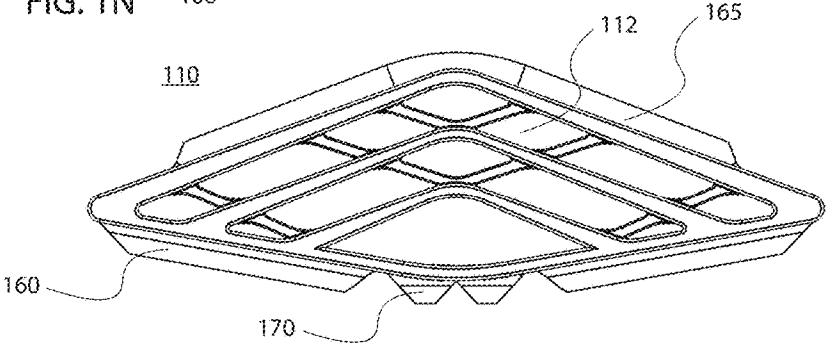
Figure 1I:
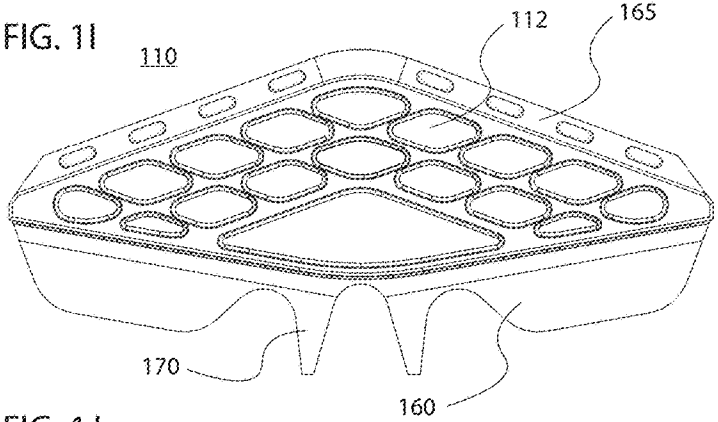
Figure 1J:
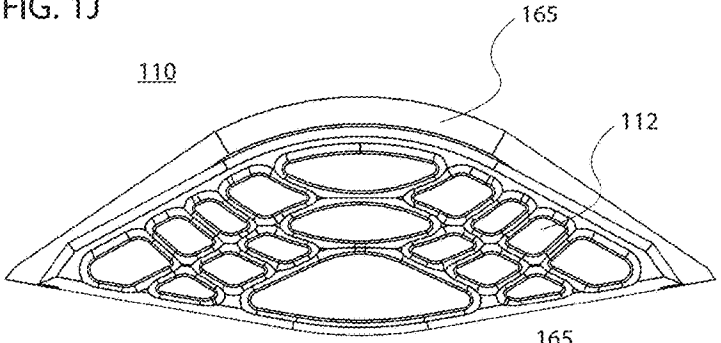
Figure 1K:
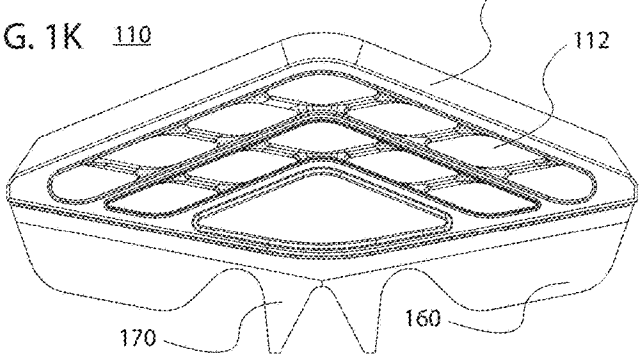
Figure 1O:
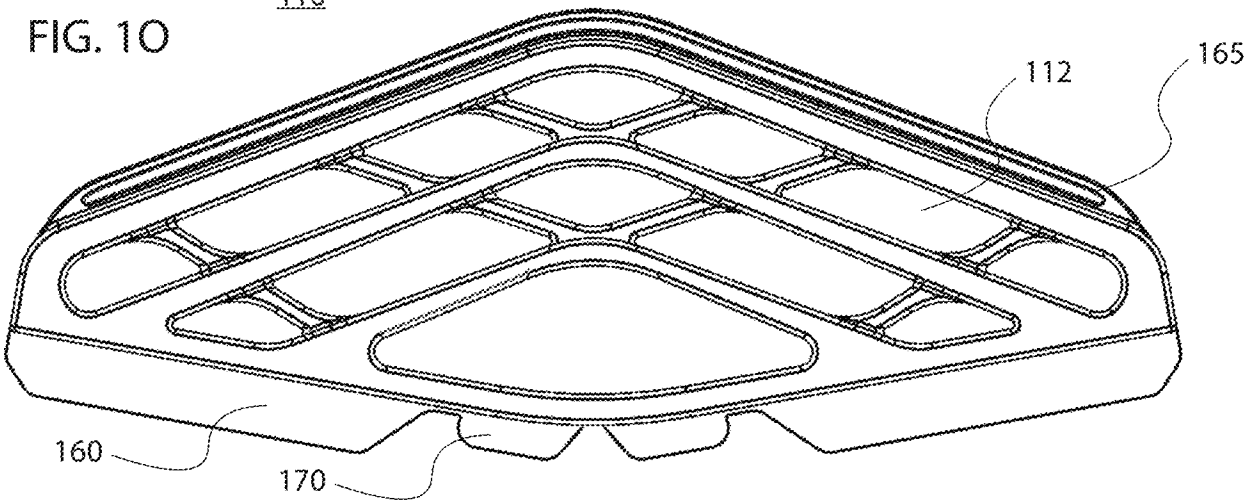
Figure 1P:
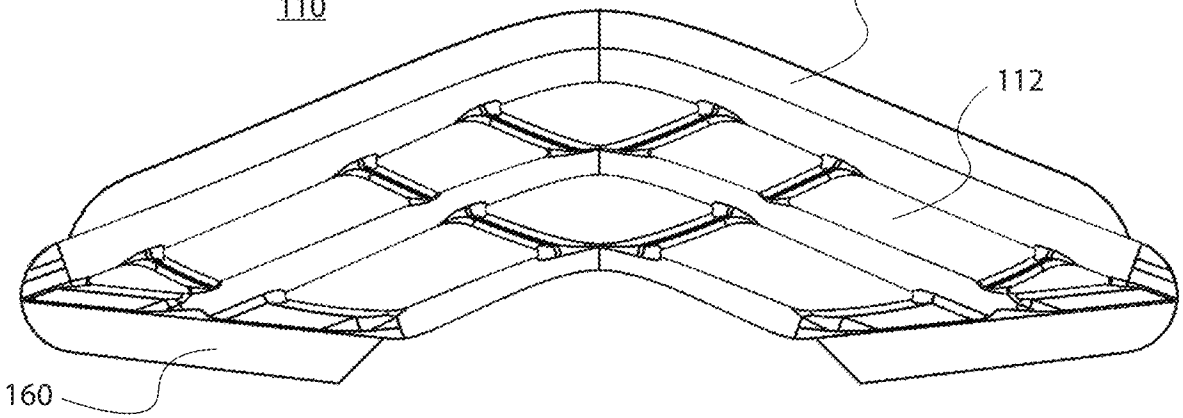

In example, embodiments, the open area defined by apertures 112 is greater than the closed area defined by lattice structure 110 itself. The one or more apertures 112 of lattice structure 110 can have various shapes. For example, the one or more apertures 112 can each have a diamond-like shape or any other elliptical, non-elliptical, or random shape, as illustrated in FIGS. 1B-1P.

As used herein, an "elliptical" shape refers to any shape that generally lacks a point where two lines, curves, or surfaces converge to form an angle. For example, an "elliptical" shape encompasses traditional Euclidian geometric shapes such as circles and ellipses, as well as other non-angular shapes (that lack any angles), even if those shapes do not have designations common in Euclidian geometry.

As used herein, a "non-elliptical" shape refers to any shape that includes at least one point where two lines, curves, or surfaces converge to form an angle. For example, a "non-elliptical" shape encompasses traditional Euclidian geometric shapes such as triangles, rectangles, squares, hexagons, trapezoids, pentagons, stars, and the like as well as other shapes that have at least one angle even if those shapes do not have designations common in Euclidian geometry.

Apertures 112 can be consistent throughout lattice structure 110 or different throughout lattice structure 110, for example, progressively changing in size and/or shape between sides, larger toward the bottom, larger toward the top, etc. Apertures 112 can be cut into a material to form lattice structure 110. Alternatively, apertures 112 can be molded. More generally, apertures 112 are defined as the open areas between the plurality of interconnected, overlapping, intersecting and/or woven ribs.

Compressible lattice structure 110 can be molded, 3D printed or otherwise formed substantially flat (e.g., as illustrated in FIGS. 1B-1P) and subsequently curved when coupled to a rapid-entry shoe. Alternatively, compressible lattice structure 110 can be molded, 3D printed or otherwise formed with some inherent curvature conforming in whole or in part to a heel portion of rapid-entry shoe 100 (e.g., as illustrated in FIGS. 6D and 6E).

In other embodiments, apertures are separated from one another by one or more folds, pleats, surface grooves and/or surface channels (e.g., a recess in the surface of a material). In yet other embodiments, apertures are separated from one another by one or more weakened portions of the compressible lattice structure 110, the relative weakness being due to at least one of a differing thickness and a differing material.

In still other embodiments, apertures themselves are comprised of folds, pleats, surface grooves or surface channels (e.g., a recess in the surface of a material). In yet other embodiments, apertures themselves are comprised of weakened portions of the compressible lattice structure 110, the relative weakness being due to at least one of a differing thickness and a differing material.

Generally, the compressible lattice structure 110 enables the rapid-entry shoe 100 to transition between an open position and a closed position in a resilient manner. For example, and with reference to FIGS. 2A and 2B, the rapid-entry shoe 100 may be in a closed position when the compressible lattice structure 110 is expanded such that the plurality of apertures 112 are un-collapsed (FIG. 2A) and the rapid-entry shoe 100 may be in an open position when the compressible lattice structure 110 is compressed downward toward a base of the rapid-entry shoe 100 such that the plurality of apertures 112 are at least partially collapsed (FIG. 2B). The open position may have an expanded shoe opening to facilitate reception of a foot of an individual wearing the rapid-entry shoe 100, while the closed position may have a smaller shoe opening to retain the foot within the rapid-entry shoe 100.

In various embodiments, the rapid-entry shoe 100 may, by default, be in the closed position (e.g., may be biased toward the closed position). Accordingly, a downward force on the lattice structure 110 (e.g., exerted by a user's heel) may compress the lattice structure 110 to collapse the plurality of apertures 112 to lower the heel portion of the shoe to the open position and thereby expand the shoe opening (through which a user's foot is inserted). Accordingly, the lattice structure may bias the rapid-entry shoe 100 toward the closed position such that in absence of a compression force driving the lattice structure 110 toward the open position, the rapid-entry shoe 100 is in the closed position.

In various embodiments, the rapid-entry shoe 100 may not necessarily be biased toward either the open or closed position. For example, the rapid-entry shoe 100 may be bi-stable and thus may be configured to have stability in both the open and closed positions. In various embodiments, stability in the open position may be accompanied by an engagement or interlocking mechanism that temporarily secures the lattice structure 110 in the collapsed state, or by other means known in the art or hereinafter developed.

Thus, as described, the compressible lattice structure 110 is generally configured to enable the heel portion of the rapid-entry shoe 100 to be collapsed downward toward the base without deflecting inward toward a shoe opening.

As used herein, a "base" of a rapid-entry shoe refers to an outsole or portions thereof, a midsole or portions thereof, an insole or portions thereof, a wedge or portions thereof, or other suitable structure disposed between and/or adjacent to the foregoing parts of a rapid-entry shoe.

Figure 2A:
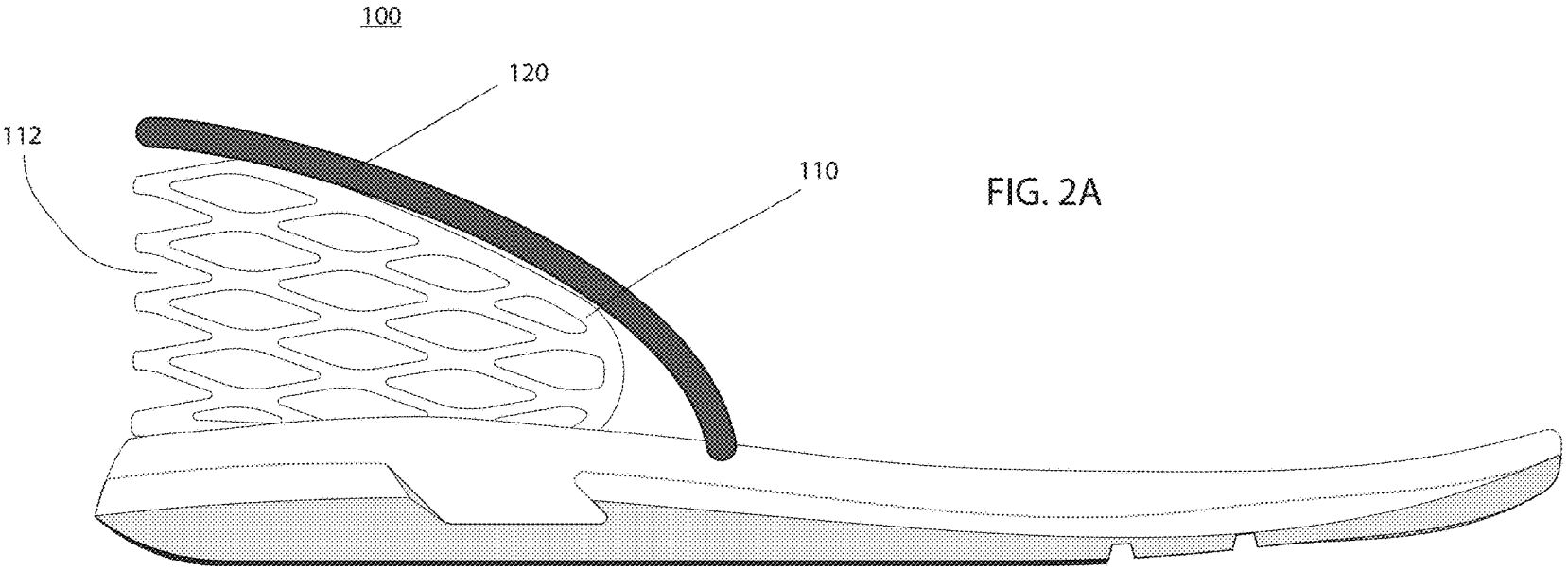
FIGS. 2A and 2B illustrate a rapid-entry shoe in a closed position and an open position, respectively, in accordance with various embodiments.
Figure 2B:
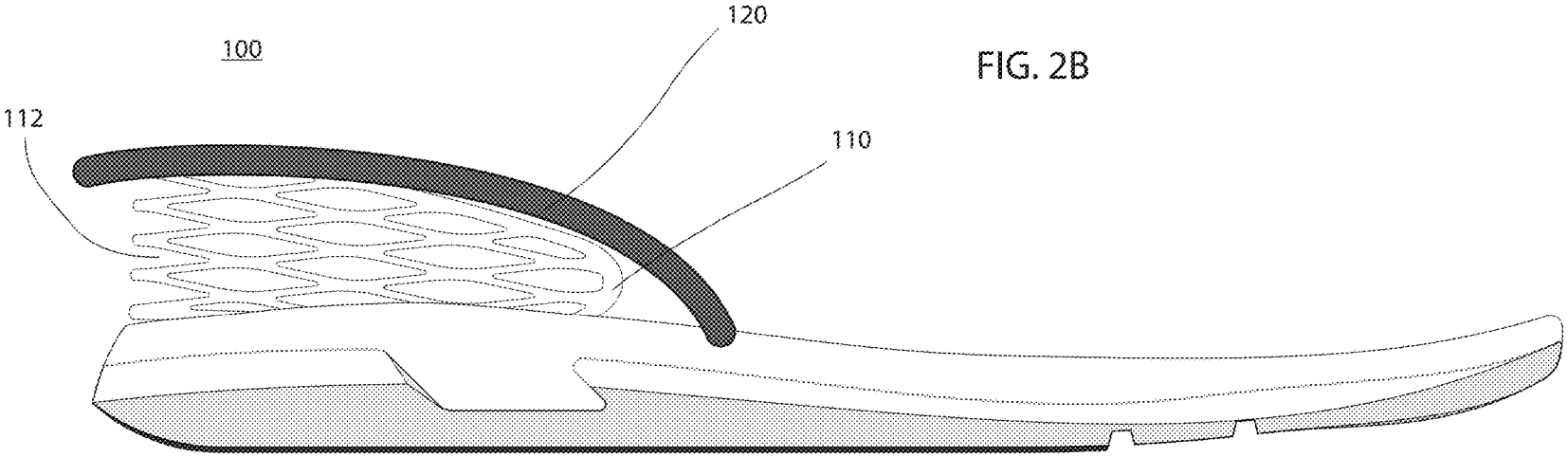

In various embodiments, and with continued reference to FIGS. 2A and 2B, the rapid-entry shoe 100 may further include a stabilizer 120 (e.g., at or near the topline of rapid-entry shoe or the top edge of the lattice structure) that imparts further stabilizing structure to the rapid-entry shoe 100 to prevent/inhibit this inward deflection or buckling.

In some embodiments, the stabilizer may be coupled to an upper edge of the compressible lattice structure 110 or the upper, and the stabilizer may prevent (or at least limit) deflection of the heel portion (e.g., the compressible lattice structure 110) of the rapid-entry shoe inward into a shoe opening. In some embodiments, the stabilizer may be integral with the lattice structure, e.g., a continuous section/portion of the lattice structure. That is, the stabilizer may be a portion/section of the lattice structure that, for example, has a higher mechanical rigidity, or is otherwise configured to prevent inward deflection of the heel portion of the shoe.

Figure 3A:
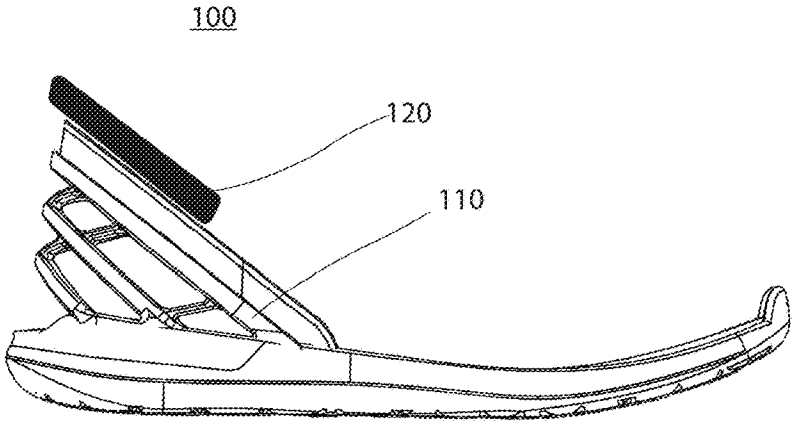
FIGS. 3A-3D illustrate various lattice structure stabilizers above the lattice structure in accordance with various embodiments.
Figure 3B:
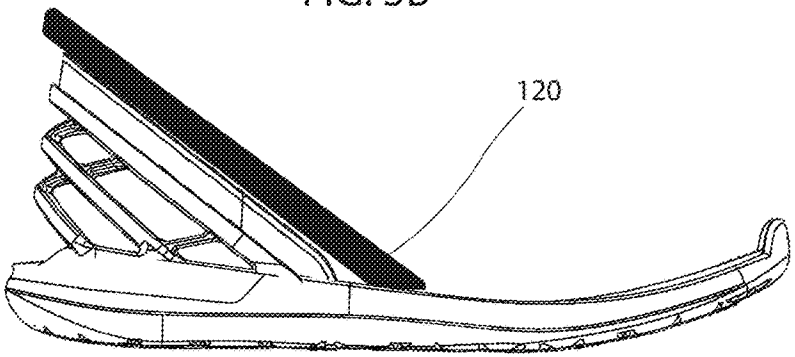
Figure 3C:
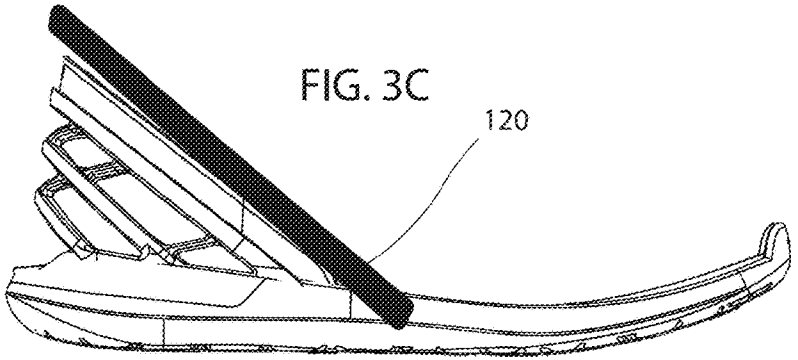
Figure 3D:
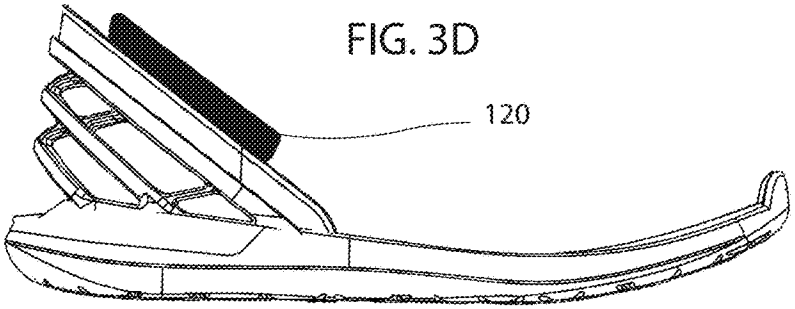
Figure 4A:
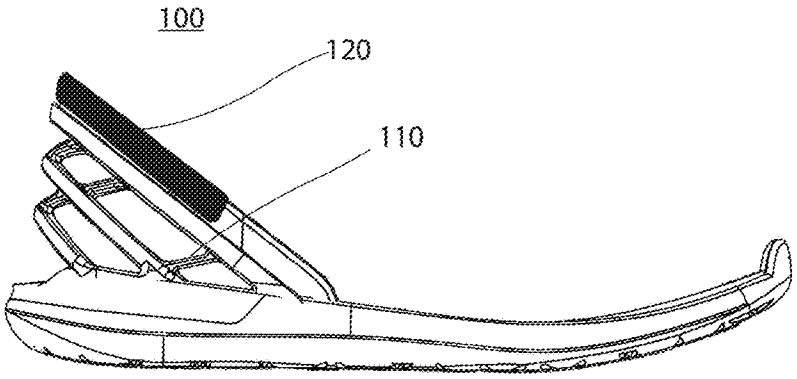
FIGS. 4A-4D illustrate various lattice structure stabilizers on a surface of the lattice structure in accordance with various embodiments.
Figure 4B:
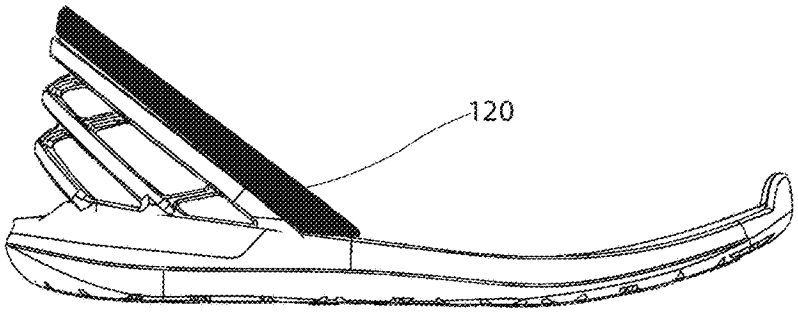
Figure 4C:
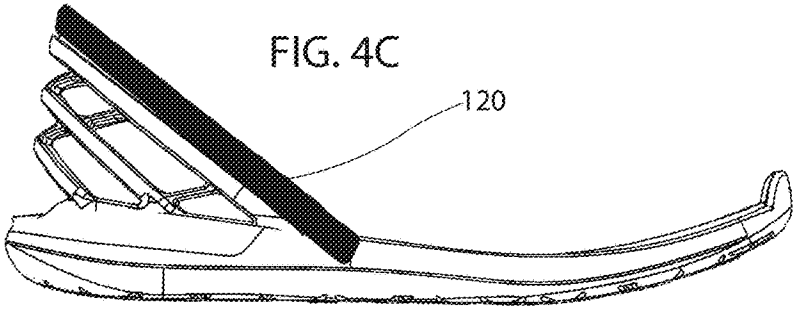
Figure 4D:
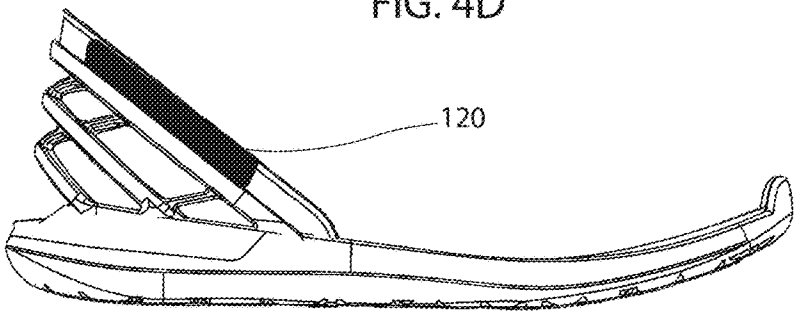

Whether coupled to or integral with the lattice structure 110, the stabilizer 120 may be completely positioned above the lattice structure 110 of rapid-entry shoe 100 (FIGS. 3A-3D) or all or partially overlap the lattice structure 110, e.g., on an outside or an inside surface of the lattice structure 110 rapid-entry shoe 100 (FIGS. 4A-4D). Additionally, the stabilizer 120 may extend partially to the base (FIGS. 3A and 4A), the stabilizer 120 may extend and be coupled completely to the base (FIGS. 3B and 4B), or the stabilizer 120 may extend and be coupled below the base (FIGS. 3C and 4C). In other embodiments, separate stabilizers 120 may be integrated into one or both of the lateral and medial sides of rapid-entry shoe 100 (FIGS. 3D and 4D). In still other embodiments, the stabilizer is not directly coupled to the lattice structure 100, but instead, to the upper of rapid-entry shoe 100.

In various embodiments, the stabilizer 120 is made from a stiff material or soft material that is assembled in a way to provide stiffness. The stabilizer 120 can be molded onto an outsole of the rapid-entry shoe 100 and then glued or otherwise coupled to the upper, or the stabilizer 120 may be made as a part of the upper and glued or otherwise coupled to the outsole. In various embodiments, the stabilizer 120 and/or the lattice structure 110 may include an overmold or other polymer or textile covering (including the shoe upper or a portion thereof) to minimize discomfort experienced by an individual wearing the shoe.

In some embodiments, the stabilizer 120 is v-shaped, u-shaped, horse-shoe-shaped (with consistent or inconsistent curvature as it rounds the rear portion of the rapid-entry shoe 100), or otherwise has an elongated shape, and thus wraps around an upper rear portion of the rapid-entry shoe 100 and/or may be connected across the back of the shoe. In other embodiments, the stabilizer may include two separate parts extending forward from the rear of the shoe, as discussed herein with reference to FIGS. 3D and 4D. The upper rear portion may include the heel portion where the lattice structure 110 is disposed. That is, the stabilizer 120 may include end points that are anchored to the base (e.g., sole) of the shoe, and thus the stabilizer 120 may extend over (e.g., wrap around) a greater extent of the rear portion of the shoe than the lattice structure 110. In various embodiments, the stabilizer 120 may include end points that are not anchored to the base (e.g., sole) of the shoe.

Accordingly, the rapid-entry shoe 100 may have a collapsible rear heel, that is prevented from buckling inwards into the foot area of the rapid-entry shoe when the heel of the rapid-entry shoe is compressed in the open position.

In various embodiments, the plurality of apertures 112 defined by the compressible lattice structure 110 are voids that accommodate the compression, and the lattice structure 110 may also provide a recoil pressure to push the heel portion of the rapid-entry shoe 100 upwards away from the base/sole, thereby enabling the lattice structure 110 to facilitate retention of the foot within the shoe. In various embodiments, the recoil or rebound may be partially or fully provided by the lattice structure 110.

Figure 5A:
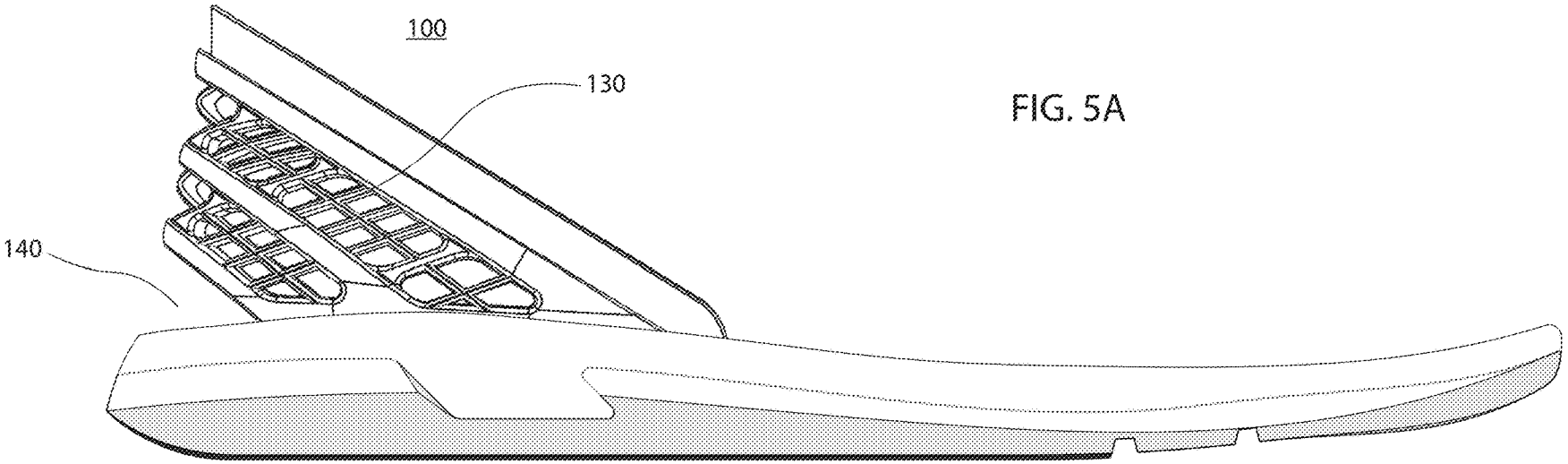
FIGS. 5A and 5B illustrate filled voids of a lattice structure, in accordance with various embodiments.
Figure 5B:
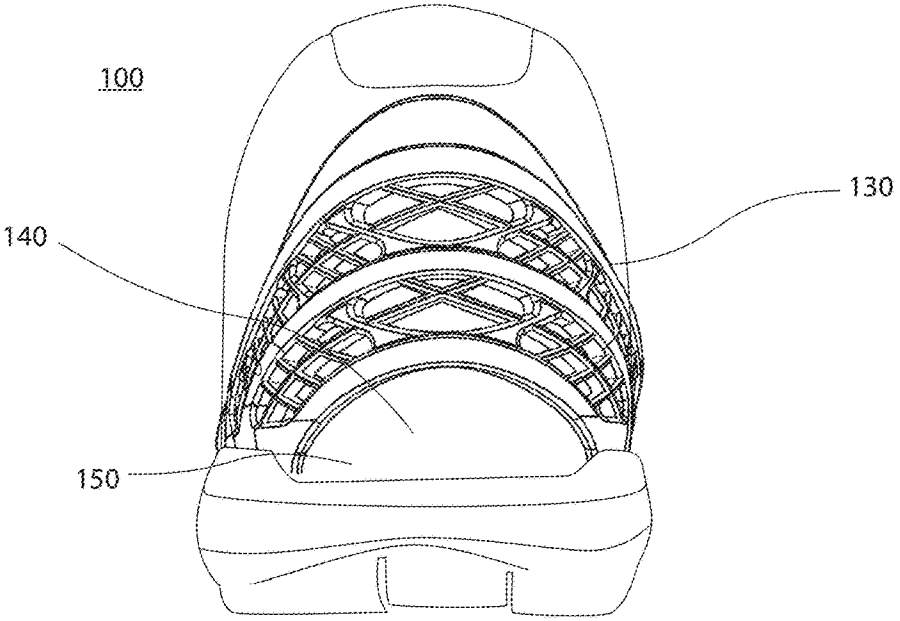

In various embodiments, one or more of the apertures 112 of the lattice structure 110 of rapid-entry shoe 100 can be filled. For example, the apertures 112 of the lattice structure 110 can be filled with a lattice substructure 130 (as illustrated in FIGS. 5A and 5B) or a continuous material (e.g., textile or polymer). In accordance with the foregoing embodiments, the lattice substructure 130 or the continuous material can contribute further to the rapid-entry shoe being biased toward the closed position. Additionally, in accordance with the foregoing embodiments, the lattice substructure 130 or the continuous material can fill the voids such that the lattice structure has a substantially smooth surface (inner or outer), for example, for comfort or appearance. The lattice structure 110 may further comprise a membrane or material covering on all or a portion of the inner or outer surface thereof.

In some embodiments, the lattice structure is in contact with the base of rapid-entry shoe continuously along an edge of the lattice structure (as illustrated in FIGS. 2A and 2B), while in other embodiments, the lattice structure is not in contact with the base of rapid-entry shoe continuously along an edge of the lattice structure. For example, there may be a discontinuity of contact at the bottom rear portion of the lattice structure resulting in a lattice relief 140 (as illustrated in FIGS. 5A and 5B). In such embodiments, there may be a corresponding midsole relief 150 at the top rear portion of the midsole (or outsole) to accommodate collapse of the lattice structure and/or upper material therein.

Figure 6A:
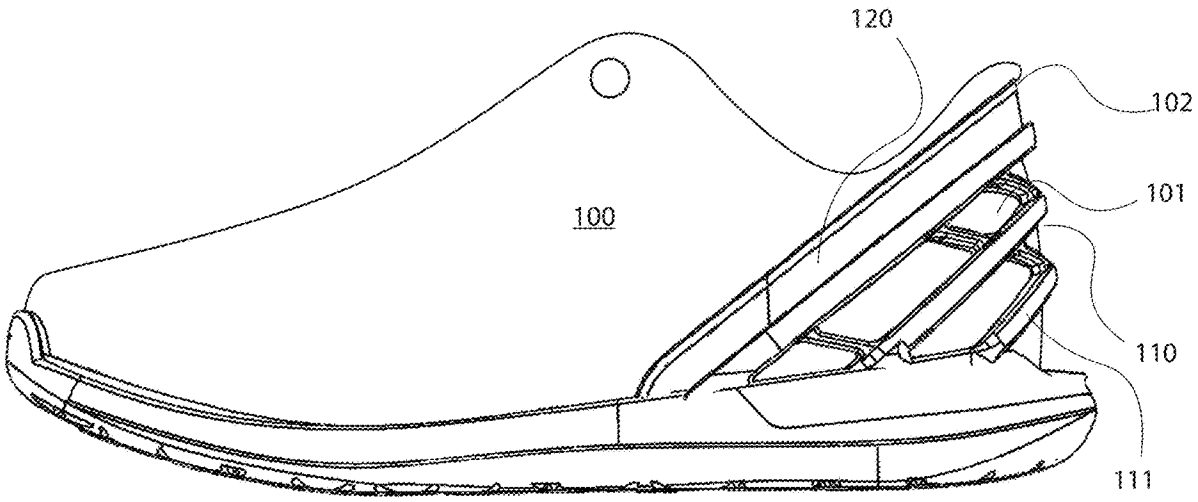
FIGS. 6A-6C illustrate a rapid-entry shoe having a compressible lattice structure and a stabilizer coupled to an upper edge of the compressible lattice structure, in accordance with various embodiments.
Figure 6B:
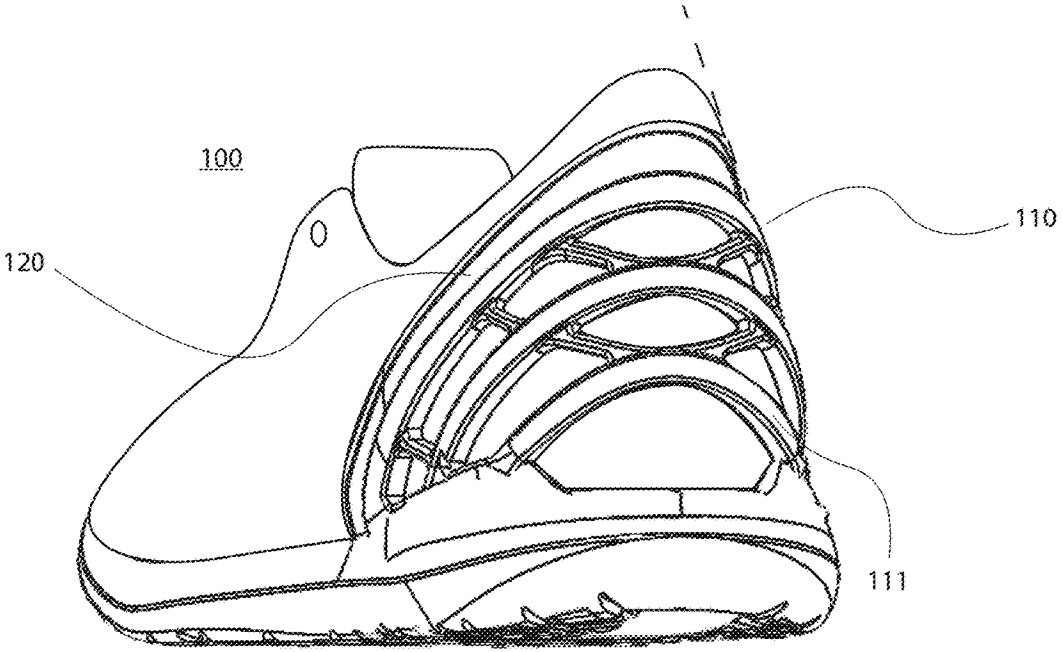
Figure 6C:
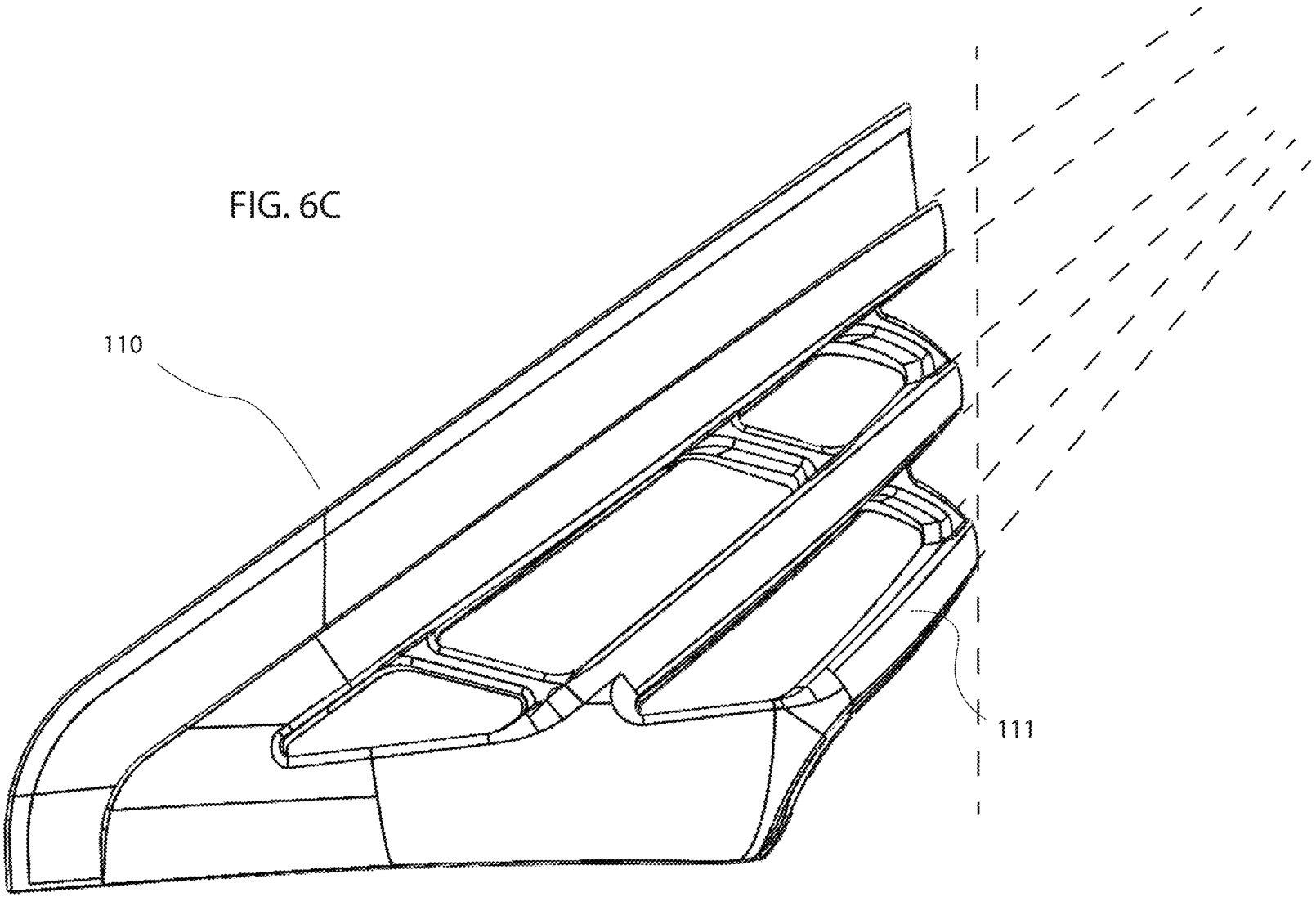
Figure 6E:
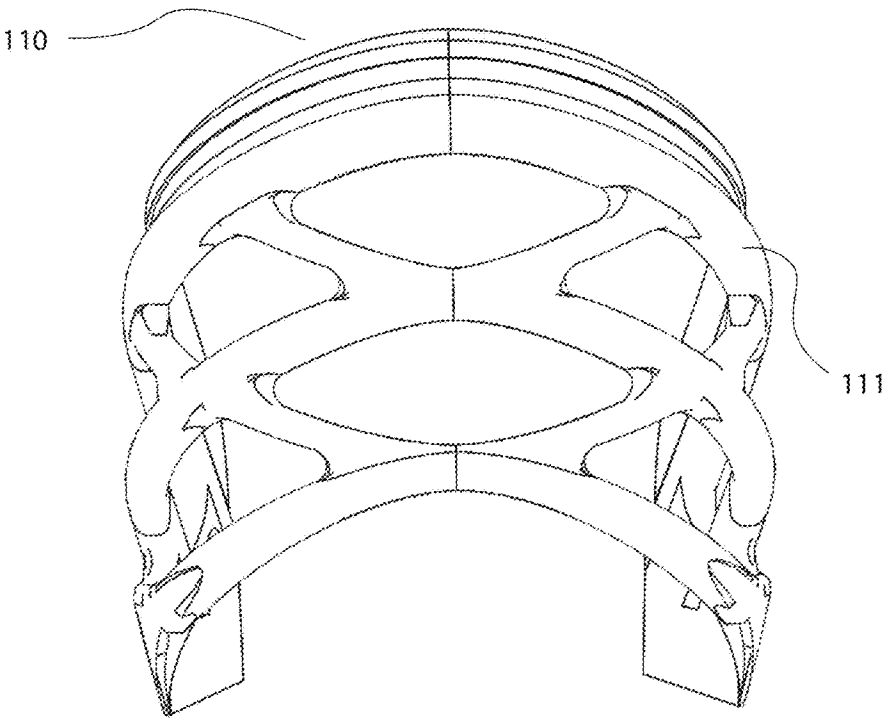
FIGS. 6D and 6E illustrate a compressible lattice structure with a stabilizer coupled, in accordance with various embodiments.
Figure 6D:
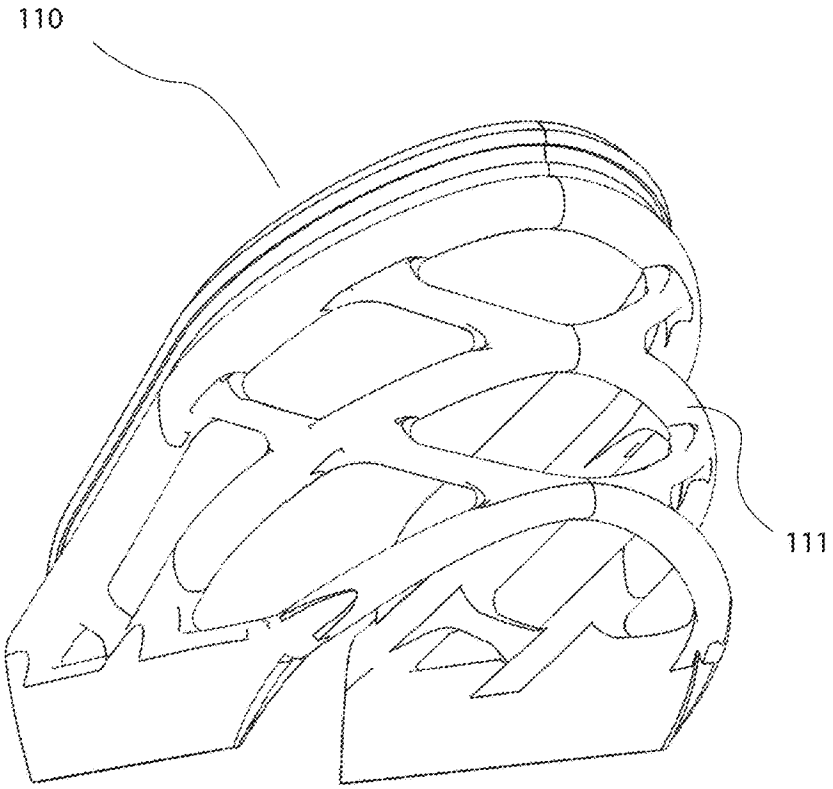

In some embodiments, and with reference to FIGS. 6A-6C, the lattice structure 110 of rapid-entry shoe 100 may comprises a plurality of ribs 111 having different dimensions. In this regard, adjacent or interconnected, overlapping, intersecting and/or woven ribs 111 of the lattice structure 110 may have different thicknesses and/or widths. In other embodiments, and with reference to FIGS. 6D and 6E, adjacent or interconnected, overlapping, intersecting and/or woven ribs 111 of the lattice structure 110 may have substantially the same thicknesses and/or widths. In some embodiments, a rib of the lattice structure 110 has a thickness of less than about 8 mm, or from about 2 mm to about 6 mm, or about 4 mm. In some embodiments, a rib of the lattice structure 110 has a width of less than about 8 mm, or from about 2 mm to about 6 mm, or about 4 mm.

In example embodiments, a plurality of larger ribs are generally concave toward the rear portion of the base of rapid-entry shoe 100, while a plurality of smaller, interconnected, overlapping, intersecting and/or woven ribs are generally convex toward the rear portion of the base of rapid-entry shoe 100.

In connection with example embodiments, ribs that are generally concave toward the rear portion of the base of rapid-entry shoe 100 may be shorter closer to the base, while ribs that are generally convex toward the rear portion of the base of rapid-entry shoe 100 may be longer closer to the base.

In example embodiments, a plurality of larger ribs are generally angled upward toward the rear portion of rapid-entry shoe 100, while a plurality of smaller, interconnected, overlapping, intersecting and/or woven ribs are generally angled downward toward the rear portion of rapid-entry shoe 100.

With specific reference to FIG. 6C, adjacent or interconnected, overlapping, intersecting and/or woven ribs 111 of the lattice structure 110 may be angled differently (i.e., not parallel). For example, and with reference to the dotted lines in FIG. 6C, each rib 111 of a lattice structure 110 may have an angle measured from the base, the angles progressively increasing or decreasing in ribs 111 further away from the base. Additionally, and with continued reference to the dotted lines in FIG. 6C, the thickness and/or width of adjacent or interconnected, overlapping, intersecting and/or woven ribs 111 of the lattice structure may vary along the length of the ribs 111 (non-uniformly or uniformly). Additionally, and with reference to the dotted lines in FIG. 6C, the distance between ribs 111 may vary. With reference to the vertical dotted line in FIG. 6C, ribs 111 located closer to the base may extend rearwardly and/or laterally more than ribs 111 located further from the base.

In accordance with example embodiments comprising structure described herein, lattice structure 110 can be configured such that ribs 111 located further from the base collapse before ribs 111 located closer to the base.

In various embodiments, and with continued reference to FIGS. 6A-6B, the lattice structure 110 and/or the stabilizer 120 may be integrated within an upper rear portion of a shoe, or it may be coupled to an interior or exterior of an upper rear portion of a shoe. For example, the lattice structure 110 may be coupled to or integrated within (e.g., internalized within) a heel or a heel cap, a heel counter or the like, and may be partially or fully exposed. In various embodiments, the lattice structure 110 may be further coupled to the base, as described below. An upper, heel or a heel cap, a heel counter or the like of rapid-entry shoe 100 may comprise a recess 101 bounded by a step 102 within which to receive the lattice structure 110 such that the intersection between the lattice structure 110 and the upper, heel or a heel cap, a heel counter or the like is flush, smooth or otherwise contiguous (as illustrated by the dotted line in FIG. 6B). In example embodiments, the recess is formed at the intersection of adjacent parts of a multi-part upper. In various embodiments, the lattice structure 110 is molded with the base and coupled to the upper.

Figure 7B:
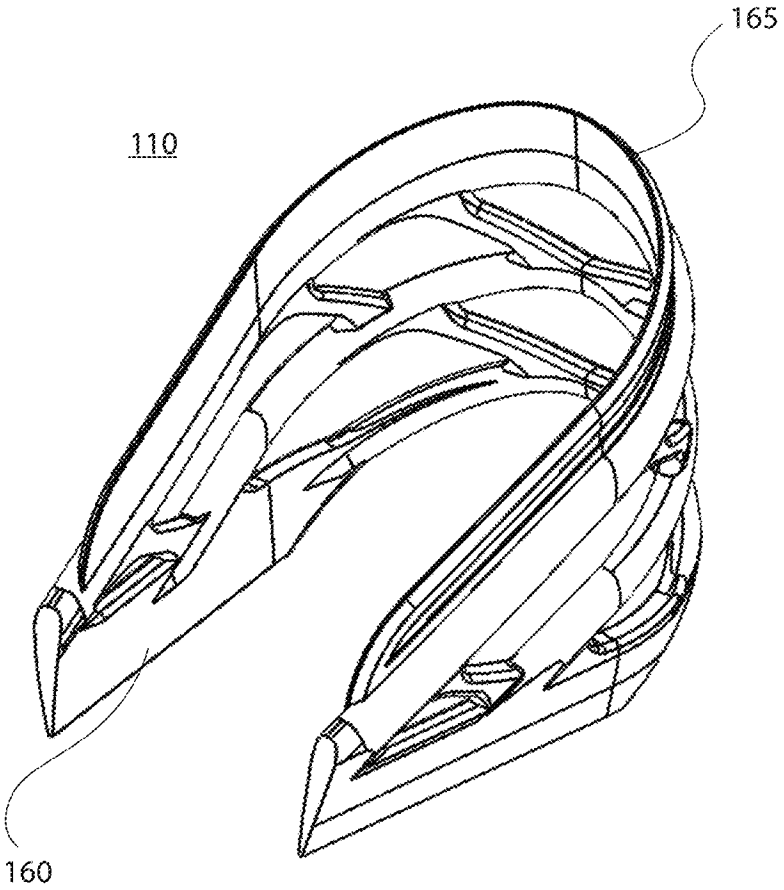
FIGS. 7A and 7B illustrate lattice structure having upper and lower flanges for coupling, in accordance with various embodiments.
Figure 7A:
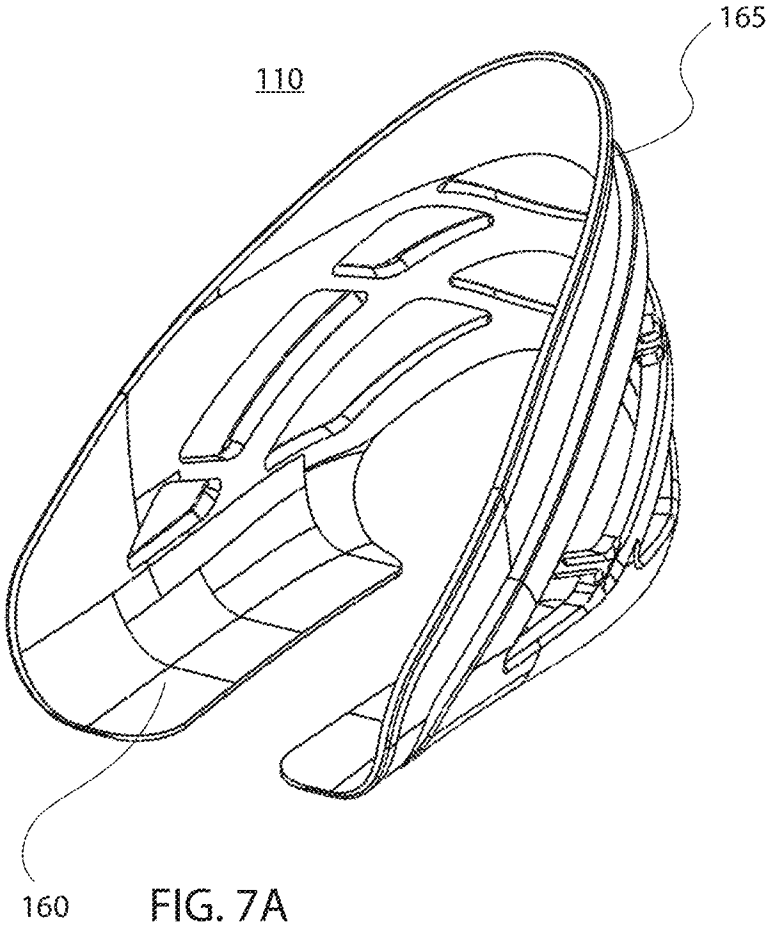

In various embodiments, the lattice structure 110 has one or more flanges that can be stitched, glued, molded directly or otherwise coupled to the upper, midsole or outsole, e.g., an upper flange coupled to the upper, and a lower flange coupled between the upper and either the midsole or the outsole. With reference to FIG. 7A, an upper flange 165 can be coupled to and extend about all or a portion of the top edge of the lattice structure 110 and a lower flange 160 can be coupled to and extend about all or a portion of the lower edge of the lattice structure 110. A lower flange 160 can extend on sides of rapid-entry shoe and/or underneath a footbed of rapid entry shoe (e.g., between an outsole and a midsole, between a midsole and an insole). Alternatively, and with reference to FIG. 7B, a lower flange 160 can extend on sides only of rapid-entry shoe (i.e., not underneath the footbed).

Additional embodiments of lattice structures 110 comprising upper flanges 165 and/or lower flanges 160 are shown in FIGS. 1H-1P. An upper flange 165 and/or a lower flange 160 can have discontinuities and/or flange extensions 170 about a rearward portion to accommodate the curvature at a rear of a rapid-entry shoe. An upper flange 165 can have a flange recess 180 at a rearward portion to accommodate an Achilles tendon of a user's foot.

Figure 8A:
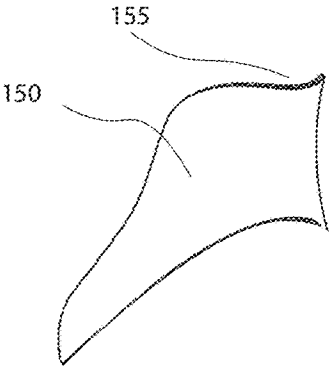
FIGS. 8A-8D illustrate a yoke in accordance with various embodiments.

With reference now to FIG. 8A, in some embodiments, a rapid-entry shoe comprises a yoke 150 configured to direct a foot into a rapid-entry shoe. Stated differently, a yoke 150 can be configured to contact the heel before the foot starts sliding forward to keep the back of the shoe from rolling forward. To accomplish the foregoing, in example embodiments, the yoke 150 can be generally horse-shoe-shaped.

Figure 8B:
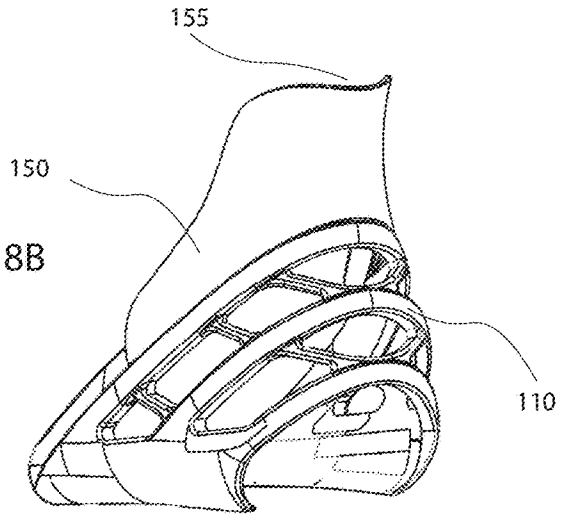
Figure 8C:
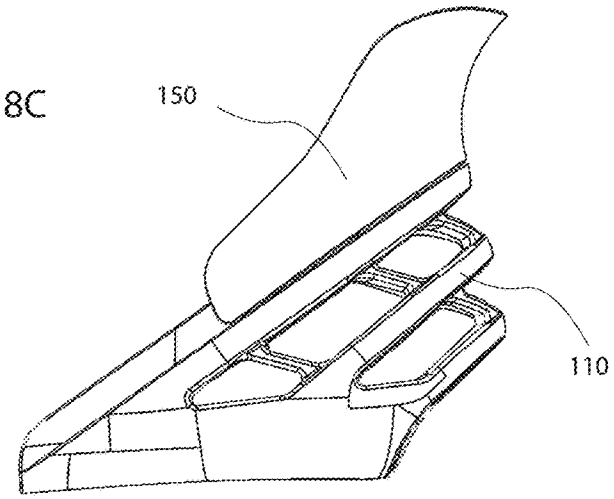
Figure 8D:
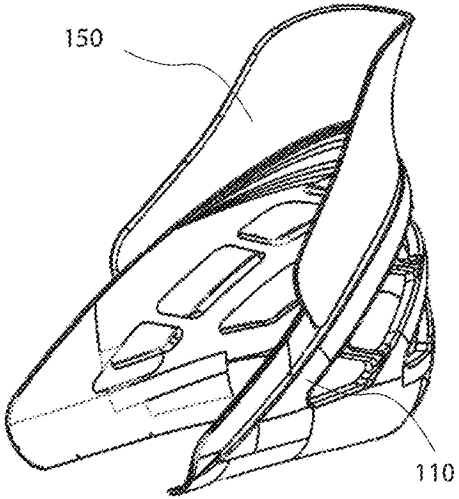

In some embodiments, a yoke extends upward to a greater distance from the base than the distance of the surrounding topline (collar) of the upper from the base. In some embodiments, a yoke extends upward to a greater distance from the base than the distance of the top edge of the tongue from the base. While a yoke 150 can be coupled to and extend in an upward direction from a lattice structure 110 and/or stabilizer as described herein (FIGS. 8B-8D), it will be apparent to those skilled in the art that a yoke 150 can be coupled to other rapid entry-shoe mechanisms, for example, those disclosed in U.S. Pat. Nos. 9,820,527 and 9,877,542, both of which are incorporated by reference herein in their entireties for all purposes.

Figure 9A:
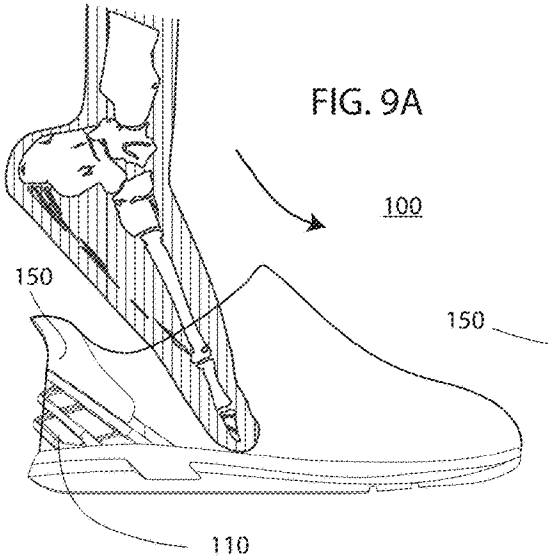
FIGS. 9A-9E illustrate open and closed positions of a yoke in accordance with various embodiments.
Figure 9B:
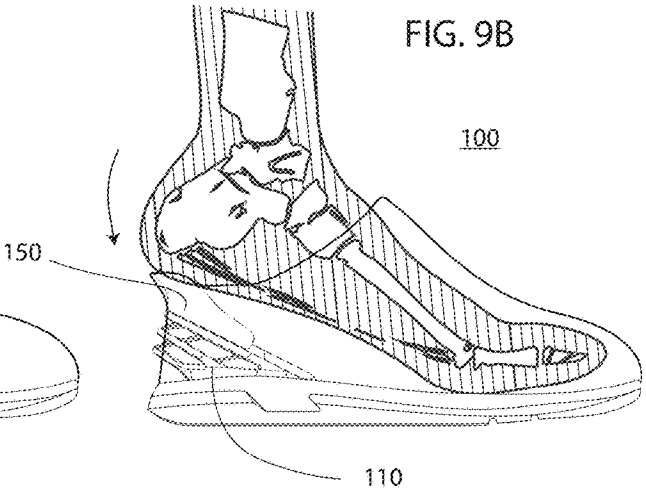
Figure 9C:
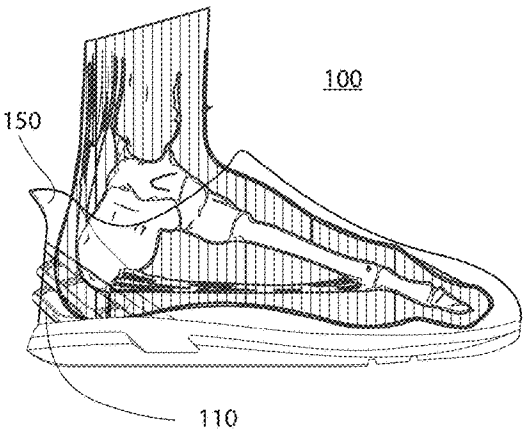
Figure 9D:
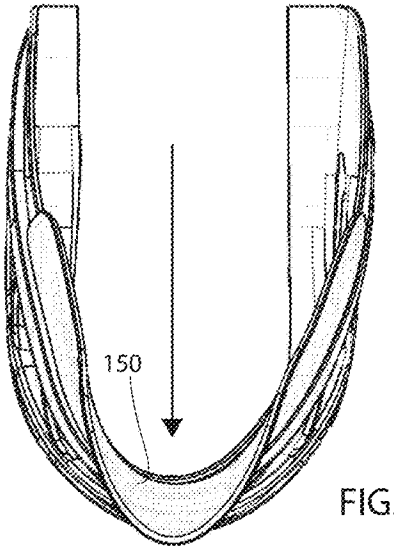
Figure 9E:
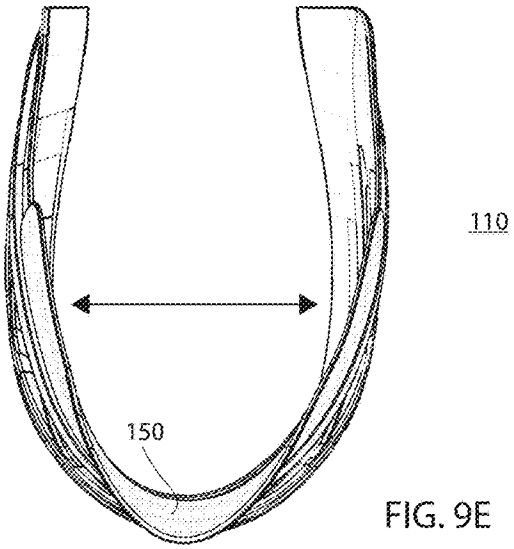

In some embodiments, the yoke 150 is further configured to expand an opening of a lattice structure 110. A foot being directed into a lattice structure 110 of a rapid-entry shoe 100 is illustrated in FIGS. 9A-9C. FIGS. 9A and 9C illustrate the lattice structure 110 in a closed position, while FIG. 9B illustrates the lattice structure 110 in an open position. As can be seen in FIGS. 9D and 9E, the yoke 150 provides for an expanded opening of a lattice structure 110 in the open position (FIG. 9E) compared to the closed position (FIG. 9D). The yoke 150 can have a yoke recess 155 at a rearward portion of an upper edge to accommodate an Achilles tendon of a user's foot.

The yoke 150 may be made from a polymer material, a metallic material, or a composite material, among others. The yoke 150 may be comprised of a material exhibiting stiffness, such that it is not compressed when the heel portion (and the lattice structure) is compressed downward toward a base of the rapid-entry shoe. In other embodiments, the yoke 150 could be comprised of a material exhibiting flexibility. In still other embodiments, the yoke 150 could be comprised of a material exhibiting stiffness with a soft covering, e.g., for comfort. The yoke 150 and the lattice structure 110 may be a unitary structure (e.g., formed from a common mold).

The present disclosure thus comprises a rapid-entry shoe having a heel portion and a yoke coupled to it, wherein in an open position the heel portion is compressed downward toward a base of the rapid-entry shoe, and in a closed position the heel portion is expanded, wherein the rapid-entry shoe is biased toward the closed position, and wherein the yoke is configured to direct a foot into the rapid-entry shoe.

Figure 10A:
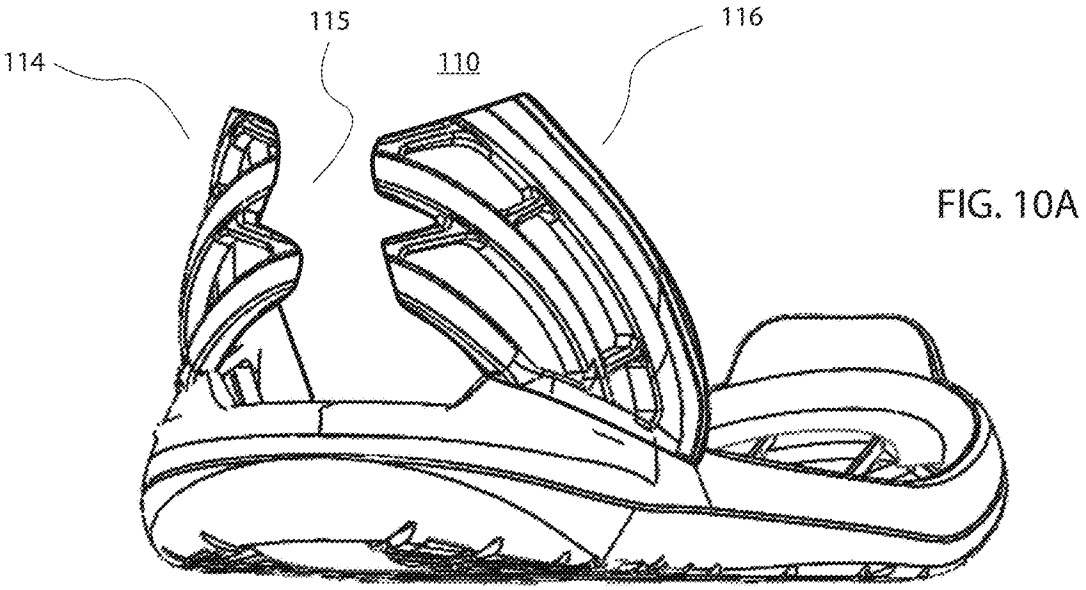
FIGS. 10A and 10B illustrate a spit lattice structure in accordance with various embodiments.
Figure 10B:
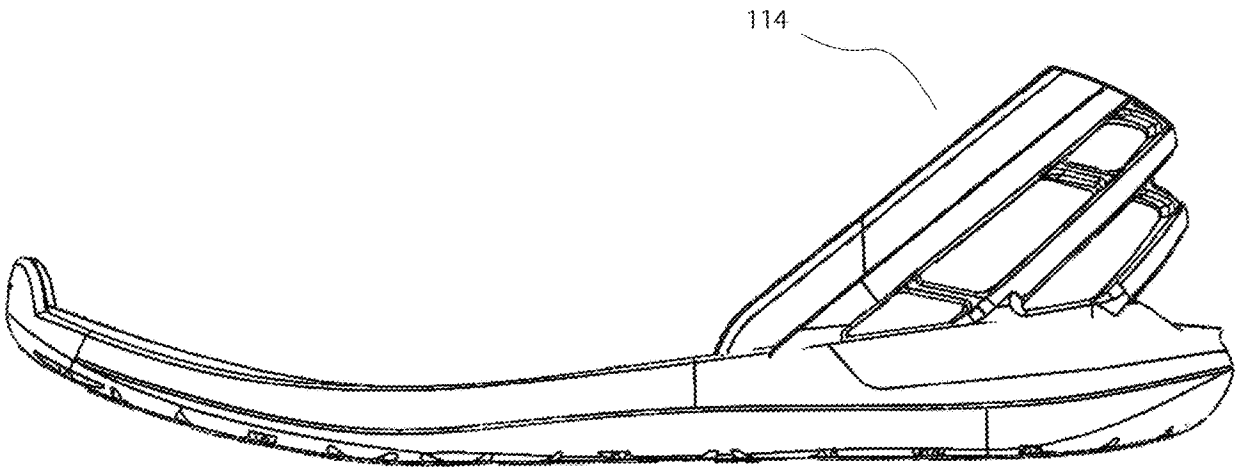

In various embodiments, and with reference to FIGS. 10A and 10B, any lattice structure 110 described herein can be split such that there is a distinct lattice structure on one or both of the lateral and medial sides of rapid-entry shoe 100, that is, a medial lattice structure 114 and a lateral lattice structure 116 separated by an open space 115.

Figure 11:
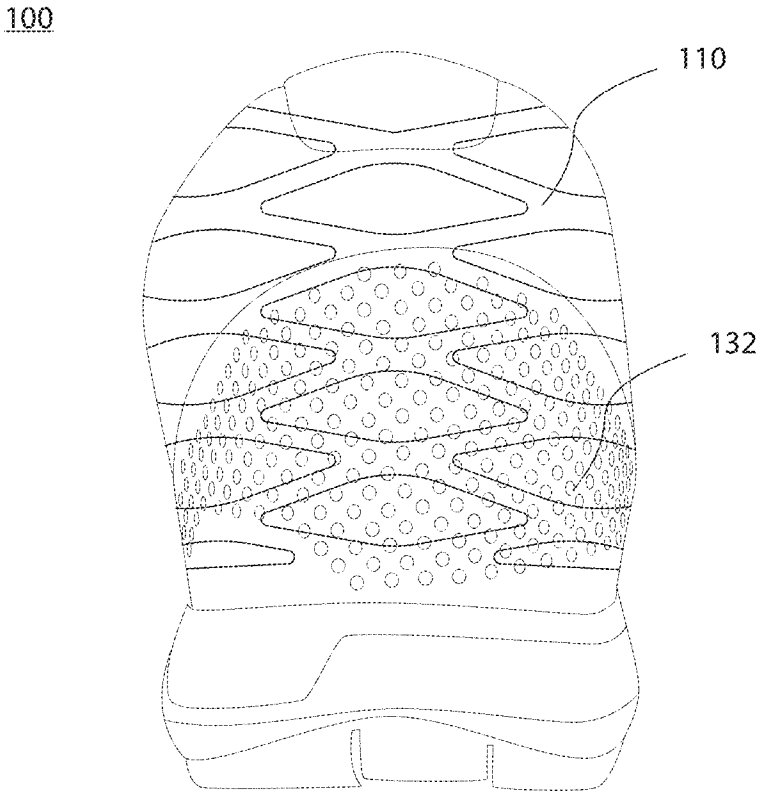
FIG. 11 illustrates a rapid entry shoe having a mesh material and a compressible lattice structure, in accordance with various embodiments.

In various embodiments, and with reference to FIG. 11, the lattice structure 110 may be separate from a material that is a mesh, knit or the like (e.g., on the inside or outside of the lattice structure 110) that has perforations or openings 132. That is, the lattice structure 110 contributes to the mechanical strength of the upper portion of the shoe, and is thus not merely a surface mesh or surface material having perforations or openings for temperature, breathability or flexibility purposes, according to various embodiments. For example, in addition to the lattice structure 110, a textile material may have perforations or other openings that may extend through and across the rear portion of the shoe.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A rapid-entry shoe comprising:

a base; and a heel portion comprising a compressible lattice structure, wherein the compressible lattice structure is comprised of a plurality of ribs, wherein the plurality of ribs defines a plurality of apertures, wherein the compressible lattice structure has an open position in which an opening of the rapid-entry shoe is expanded to facilitate reception of a foot of an individual donning the rapid-entry shoe, and wherein the compressible lattice structure has a closed position in which the opening is unexpanded to retain the foot within the rapid-entry shoe;

wherein the plurality of ribs comprises a plurality of larger ribs;

wherein the plurality of ribs comprises a plurality of smaller ribs;

wherein the plurality of larger ribs and the plurality of smaller ribs are comprised of a unitary structure formed from a single mold;

wherein a plurality of smaller ribs extend between immediately adjacent ribs of the plurality of larger ribs;

wherein in the open position the compressible lattice structure is compressed downward toward the base of the rapid-entry shoe such that the plurality of apertures are collapsed;

wherein in the closed position the compressible lattice structure is expanded such that the plurality of apertures are un-collapsed; and wherein the compressible lattice structure biases the rapid-entry shoe toward the closed position.

2. The rapid-entry shoe of claim 1, wherein the plurality of apertures are open, pass- through holes.

3. The rapid-entry shoe of claim 1, wherein the compressible lattice structure is integrated within an upper rear portion of the rapid-entry shoe.

4. The rapid-entry shoe of claim 1, wherein an upper of the rapid-entry shoe comprises a recess bounded by a step within which to receive the compressible lattice structure such that the intersection between the compressible lattice structure and the upper of the rapid-entry shoe is substantially flush.

5. The rapid-entry shoe of claim 1, wherein a bottom rear portion of the compressible lattice structure comprises a lattice relief and a top rear portion of a midsole or an outsole comprises a midsole relief to accommodate collapse of the compressible lattice structure or an upper therein.

6. The rapid-entry shoe of claim 1, wherein each of the plurality of larger ribs is concave toward a rear portion of the base, and wherein each of the plurality of smaller ribs is convex toward the rear portion.

7. A rapid-entry shoe comprising:

a base; and a heel portion comprising a lattice structure, wherein the lattice structure is comprised of a plurality of intersecting ribs, wherein the plurality of intersecting ribs defines a plurality of apertures, wherein the lattice structure has an open position in which an opening of the rapid-entry shoe is expanded to facilitate reception of a foot of an individual donning the rapid-entry shoe, and wherein the lattice structure has a closed position in which the opening is unexpanded to retain the foot within the rapid-entry shoe;

a flange located proximal a bottom edge of the lattice structure;

a stabilizer located proximal a top edge of the lattice structure;

wherein the plurality of intersecting ribs comprises a plurality of larger ribs;

wherein the plurality of intersecting ribs comprises a plurality of smaller ribs;

wherein each of the plurality of larger ribs comprises a length extending between a lateral side of the flange and a medial side of the flange;

wherein each of the plurality of smaller ribs comprises a length extending between a lateral side of the stabilizer and a medial side of the stabilizer;

wherein the length of the larger ribs is progressively shorter toward the base;

wherein the length of the smaller ribs is progressively longer toward the base;

wherein in the open position the lattice structure is compressed downward toward the base of the rapid-entry shoe such that the plurality of apertures are collapsed;

wherein in the closed position the lattice structure is expanded such that the plurality of apertures are un-collapsed; and wherein the lattice structure biases the rapid-entry shoe toward the closed position.

8. The rapid-entry shoe of claim 7, wherein the plurality of apertures are open, pass-through holes.

9. The rapid-entry shoe of claim 7, wherein the lattice structure is integrated within an upper rear portion of the rapid-entry shoe.

10. The rapid-entry shoe of claim 7, wherein an upper of the rapid-entry shoe comprises a recess bounded by a step within which to receive the lattice structure such that the intersection between the lattice structure and the upper of the rapid-entry shoe is substantially flush.

11. The rapid-entry shoe of claim 7, wherein a bottom rear portion of the lattice structure comprises a lattice relief and a top rear portion of a midsole or an outsole comprises a midsole relief to accommodate collapse of the lattice structure or an upper therein.

12. A rapid-entry shoe comprising:

a base; and a heel portion comprising a lattice structure, wherein the lattice structure is comprised of a plurality of ribs, wherein the plurality of ribs defines a plurality of apertures, wherein the lattice structure has an open position in which an opening of the rapid- entry shoe is expanded to facilitate reception of a foot of an individual donning the rapid-entry shoe, and wherein the lattice structure has a closed position in which the opening is unexpanded to retain the foot within the rapid-entry shoe;

wherein the plurality of ribs comprises a plurality of larger ribs;

wherein the plurality of ribs comprises a plurality of smaller ribs;

wherein a plurality of smaller ribs are positioned between immediately adjacent ribs of the plurality of larger ribs;

wherein in the open position the lattice structure is compressed downward toward the base of the rapid-entry shoe such that the plurality of apertures are collapsed;

wherein in the closed position the lattice structure is expanded such that the plurality of apertures are un-collapsed; and wherein the lattice structure biases the rapid-entry shoe toward the closed position.

13. The rapid-entry shoe of claim 12, wherein the plurality of apertures are open, pass-through holes.

14. The rapid-entry shoe of claim 12, wherein the lattice structure is integrated within an upper rear portion of the rapid-entry shoe.

15. The rapid-entry shoe of claim 12, wherein an upper of the rapid-entry shoe comprises a recess bounded by a step within which to receive the lattice structure such that the intersection between the lattice structure and the upper of the rapid-entry shoe is substantially flush.

16. The rapid-entry shoe of claim 12, wherein a bottom rear portion of the lattice structure comprises a lattice relief and a top rear portion of a midsole or an outsole comprises a midsole relief to accommodate collapse of the lattice structure or an upper therein.

17. A rapid-entry shoe comprising:

a base;

a heel portion comprising a compressible lattice structure, wherein the compressible lattice structure is comprised of a plurality of ribs, wherein the plurality of ribs defines a plurality of apertures, wherein the compressible lattice structure has an open position in which an opening of the rapid-entry shoe is expanded to facilitate reception of a foot of an individual donning the rapid-entry shoe, and wherein the compressible lattice structure has a closed position in which the opening is unexpanded to retain the foot within the rapid-entry shoe; and a flange located proximal a bottom edge of the compressible lattice structure and configured to be coupled to the base;

wherein the plurality of ribs comprises a plurality of larger ribs;

wherein the plurality of ribs comprises a plurality of smaller ribs;

wherein at least one end of each of the plurality of larger ribs terminates at the flange;

wherein in the open position the compressible lattice structure is compressed downward toward the base of the rapid-entry shoe such that the plurality of apertures are collapsed;

wherein in the closed position the compressible lattice structure is expanded such that the plurality of apertures are un-collapsed; and wherein the compressible lattice structure biases the rapid-entry shoe toward the closed position.

18. The rapid-entry shoe of claim 17, wherein the plurality of apertures are open, pass-through holes.

19. The rapid-entry shoe of claim 17, wherein an upper of the rapid-entry shoe comprises a recess bounded by a step within which to receive the compressible lattice structure such that the intersection between the compressible lattice structure and the upper of the rapid-entry shoe is substantially flush.

20. The rapid-entry shoe of claim 17, wherein a bottom rear portion of the compressible lattice structure comprises a lattice relief and a top rear portion of a midsole or an outsole comprises a midsole relief to accommodate collapse of the compressible lattice structure or an upper therein.

* * * * *